US006740292B2

(12) United States Patent
Arrell et al.

(10) Patent No.: US 6,740,292 B2
(45) Date of Patent: May 25, 2004

(54) NICKEL-BASE SUPERALLOY

(75) Inventors: Douglas Arrell, Finspong (SE); Mohamed Nazmy, Fislisbach (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/400,415

(22) Filed: Mar. 28, 2003

(65) Prior Publication Data

US 2004/0005238 A1 Jan. 8, 2004

(30) Foreign Application Priority Data

Apr. 30, 2002 (CH) ..... 0745/02

(51) Int. Cl.[7] ..... C22C 19/05

(52) U.S. Cl. ..... 420/448; 420/450; 420/451; 420/454; 420/460; 148/428

(58) Field of Search ..... 148/428; 420/448, 420/450, 451, 454, 460

(56) References Cited

U.S. PATENT DOCUMENTS

| | | | | |
|---|---|---|---|---|
| 4,461,659 A | * | 7/1984 | Harris | 148/404 |
| 4,639,280 A | * | 1/1987 | Fredholm et al. | 148/404 |
| 4,643,782 A | | 2/1987 | Harris et al. | |
| 4,677,035 A | * | 6/1987 | Fiedler et al. | 428/680 |
| 4,719,080 A | * | 1/1988 | Duhl et al. | 420/443 |
| 4,885,216 A | | 12/1989 | Naik | 428/680 |
| 5,270,123 A | | 12/1993 | Walston et al. | |
| 5,435,861 A | | 7/1995 | Khan et al. | 148/428 |
| 6,051,083 A | * | 4/2000 | Tamaki et al. | 148/410 |

FOREIGN PATENT DOCUMENTS

| | | |
|---|---|---|
| EP | 0 208 645 | 1/1987 |
| FR | 2 557 598 | 7/1985 |
| GB | 2105748 A | 3/1983 |
| GB | 2 234 521 | 2/1991 |
| GB | 2234521 | 2/1991 |

OTHER PUBLICATIONS

Bouhanek et al., "Mechanical Stability of Oxide Layers Resulting from Single–Crystal Superalloys Oxidation" Chemical Abstracts XP002209149.

Search Report Jun. 10, 2003 European Patent Office.

Chemical Abstract; Bouhanek, K., "Mechanical stability of oxide layers resulting from single–crystal superalloys oxidation" retrieved from STN Database accession No. 124:322825 CA, XP002209149 Zusammenfassung & MATER. TECH. (PARIS) (1995), 83 (NUM. HORS SER.), 59–61, 1995.

Search Report, provided by the European Patent Office, for Swiss patent Appl. No. CH 7452002, dated Aug. 29, 2002.

* cited by examiner

*Primary Examiner*—John Sheehan
(74) *Attorney, Agent, or Firm*—Adam J. Cermak

(57) ABSTRACT

The invention relates to a nickel-base superalloy. The alloy according to the invention is characterized by the following chemical composition (details in % by weight): 7.7–8.3 Cr, 5.0–5.25 Co, 2.0–2.1 Mo, 7.8–8.3 W, 5.8–6.1 Ta, 4.9–5.1 Al, 1.3–1.4 Ti, 0.11–0.15 Si, 0.11–0.15 Hf, 200–750, preferably 200–300 ppm of C, 50–400, preferably 50–100 ppm of B, remainder Ni and production-related impurities. It is distinguished by very good castability and a high resistance to oxidation.

3 Claims, 5 Drawing Sheets

NICKEL-BASE SUPERALLOY

BACKGROUND OF THE INVENTION

1. Field of the Invention

The invention deals with the field of materials science. It relates to a nickel-base superalloy, in particular for the production of single-crystal components (SX alloy) or components with a directionally solidified microstructure (DS alloy), such as for example blades or vanes for gas turbines. However, the alloy according to the invention can also be used for conventionally cast components.

2. Discussion of Background

Nickel-base superalloys of this type are known. Single-crystal components made from these alloys have a very good material strength at high temperatures. As a result, by way of example the inlet temperature of gas turbines can be increased, so that the gas turbine becomes more efficient.

Nickel-base superalloys for single-crystal components, as are known from U.S. Pat. No. 4,643,782, EP 0 208 645 and U.S. Pat. No. 5,270,123, for this purpose contain solid-solution-strengthening alloying elements, for example Re, W, Mo, Co, Cr, and γ'-phase-forming elements, for example Al, Ta and Ti. The level of high-melting alloying elements (W, Mo, Re) in the basic matrix (austenitic γ phase) increases continuously with the increase in the alloy loading temperature. For example, standard nickel-base superalloys for single crystals contain 6–8% of W, up to 6% of Re and up to 2% of Mo (details in % by weight). The alloys disclosed in the abovementioned documents have a high creep rupture strength, good LCF (Low Cycle Fatigue) and HCF (High Cycle Fatigue) properties and a high resistance to oxidation.

These known alloys were developed for aircraft turbines and were therefore optimized for short-term and medium-term use, i.e. the loading duration is designed for up to 20,000 hours. By contrast, industrial gas turbine components have to be designed for a loading duration of up to 75,000 hours.

By way of example, after a loading duration of 300 hours, the alloy CMSX-4 described in U.S. Pat. No. 4,643,782, when used in tests in a gas turbine at a temperature of over 1000° C., reveals considerable coarsening of the γ' phase, which is disadvantageously associated with an increase in the creep rate of the alloy.

It is therefore necessary to improve the oxidation resistance of the known alloys at very high temperatures.

A further problem of the known nickel-base superalloys, for example the alloys which are known from U.S. Pat. No. 5,435,861, consists in the fact that the castability for large components, e.g. gas turbine blades or vanes with a length of more than 80 mm, leaves something to be desired. It is extremely difficult to cast a perfect, relatively large directionally solidified single-crystal component from a nickel-base superalloy, since most of these components have defects, for example small-angle grain boundaries, freckles (i.e. defects caused by a sequence of uniaxially oriented grains with a high eutectic content), equiaxial scatter boundaries, microporosities, etc. These defects weaken the components at high temperatures, so that the desired service life or operating temperature of the turbine is not reached. However, since a perfectly cast single-crystal component is extremely expensive, industry tends to allow as many defects as possible without the service life or the operating temperature being impaired.

One of the most frequent defects is grain boundaries, which are particularly harmful to the high-temperature properties of the single-crystal article. Although small-angle grain boundaries have only a relatively small influence on the properties of small components, they are highly relevant with regard to the castability and oxidation characteristics at high temperatures in the case of large SX or DS components.

Grain boundaries are regions of high local disorder of the crystal lattice, since the adjacent grains abut one another in these regions and therefore there is a certain misorientation between the crystal lattices. The greater the misorientation, the greater the disorder, i.e. the larger the number of dislocations in the grain boundaries which are necessary for the two grains to fit together. This disorder is directly related to the performance of the material at high temperatures. It weakens the material when the temperature rises above the equicohesive temperature (=0.5×melting point in K).

This effect is known from GB 2 234 521 A. For example, in a conventional nickel-base single-crystal alloy, the fracture strength drops greatly at a test temperature of 871° C. if the misorientation of the grains is greater than 6°. This was also recorded with single-crystal components with a directionally solidified microstructure, and consequently opinion has tended to be not to allow misorientations of greater than 6°.

It is also known from the abovementioned GB 2 234 521 A that enriching nickel-base superalloys with boron or carbon with directional solidification results in microstructures which have an equiaxial or prismatic grain structure. Carbon and boron strengthen the grain boundaries, since C and B cause the precipitation of carbides and borides at the grain boundaries, which are stable at high temperatures. Moreover, the presence of these elements in and along the grain boundaries reduces the diffusion process, which is a primary cause of grain boundary weakness. It is therefore possible to increase the misorientations to 10° to 12° yet still achieve good properties of the material at high temperatures. Particularly in the case of large single-crystal components made from nickel-base superalloys, however, these small-angle grain boundaries have an adverse effect on the properties.

SUMMARY OF THE INVENTION

Accordingly, one object of the invention is to avoid the abovementioned drawbacks. The invention is based on the object of developing a nickel-base superalloy which has an improved castability and a higher resistance to oxidation compared to known nickel-base superalloys. Moreover, this alloy is to be particularly suitable, for example, for large gas-turbine single-crystal components with a length of >80 mm.

According to the invention, this object is achieved through the fact that the nickel-base superalloy is characterized by the following chemical composition (details in % by weight):

7.7–8.3 Cr
5.0–5.25 Co
2.0–2.1 Mo
7.8–8.3 W
5.8–6.1 Ta
4.9–5.1 Al
1.3–1.4 Ti
0.11–0.15 Si
0.11–0.15 Hf

200–750 ppm C

50–400 ppm B remainder nickel and production-related impurities.

The advantages of the invention consist in the fact that the alloy has very good casting properties and also has an improved resistance to oxidation at high temperatures compared to the previously known prior art.

It is particularly advantageous if the alloy has the following composition:

7.7–8.3 Cr 5.0–5.25 Co 2.0–2.1 Mo 7.8–8.3 W 5.8–6.1 Ta 4.9–5.1 Al 1.3–1.4 Ti 0.11–0.15 Si 0.11–0.15 Hf

200–300 ppm C

50–100 ppm B remainder nickel and production-related impurities. This alloy is eminently suitable for the production of large single-crystal components, for example blades or vanes for gas turbines.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which illustrate an exemplary embodiment of the invention on the basis of quasi-isothermal oxidation diagrams and wherein.

DESCRIPTION OF THE PREFERRED EMBODIMENTS

Figure 1:
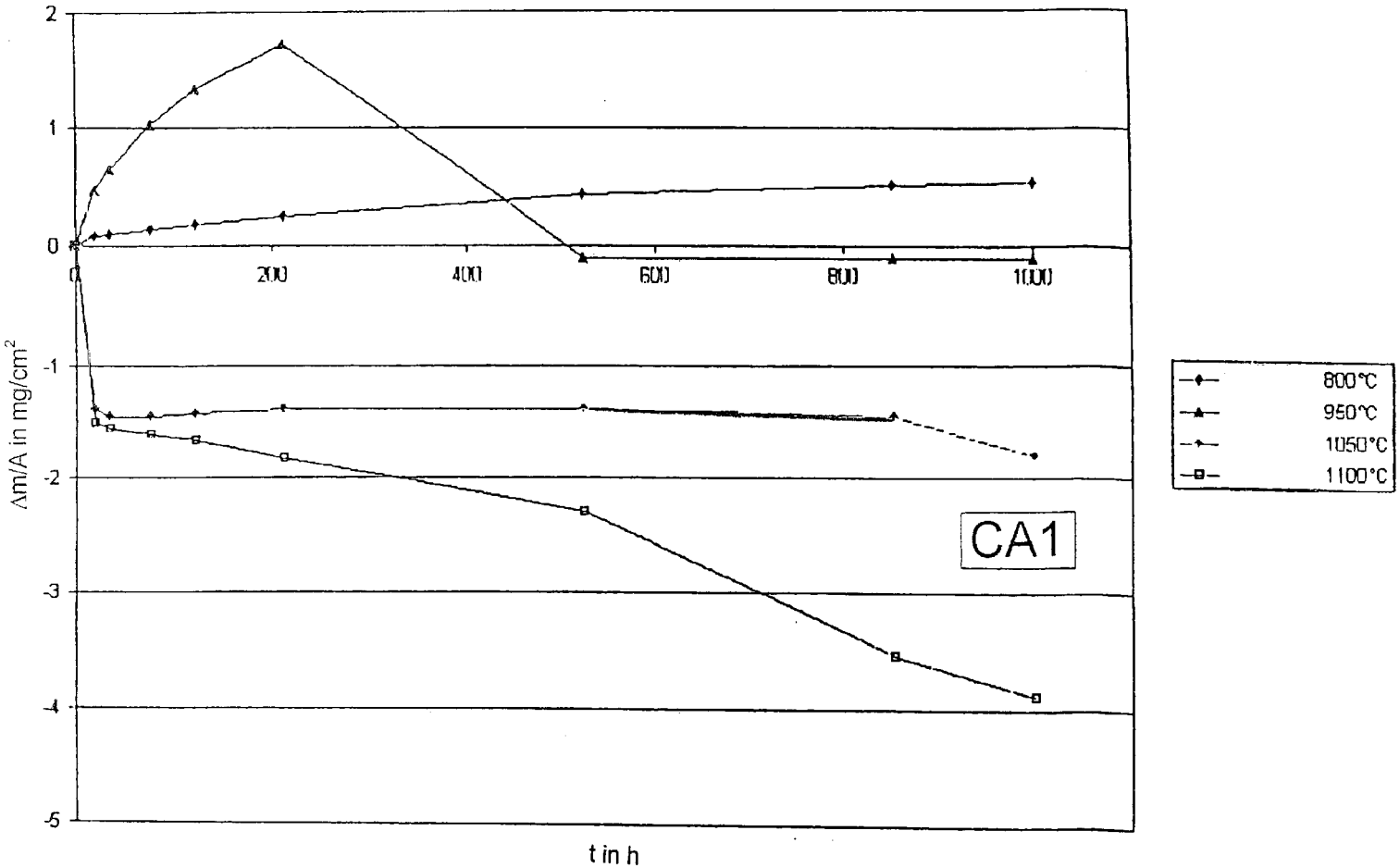
FIG. 1 shows the way in which the specific mass change is dependent on the temperature and time for the comparison alloy CA1.
Figure 2:
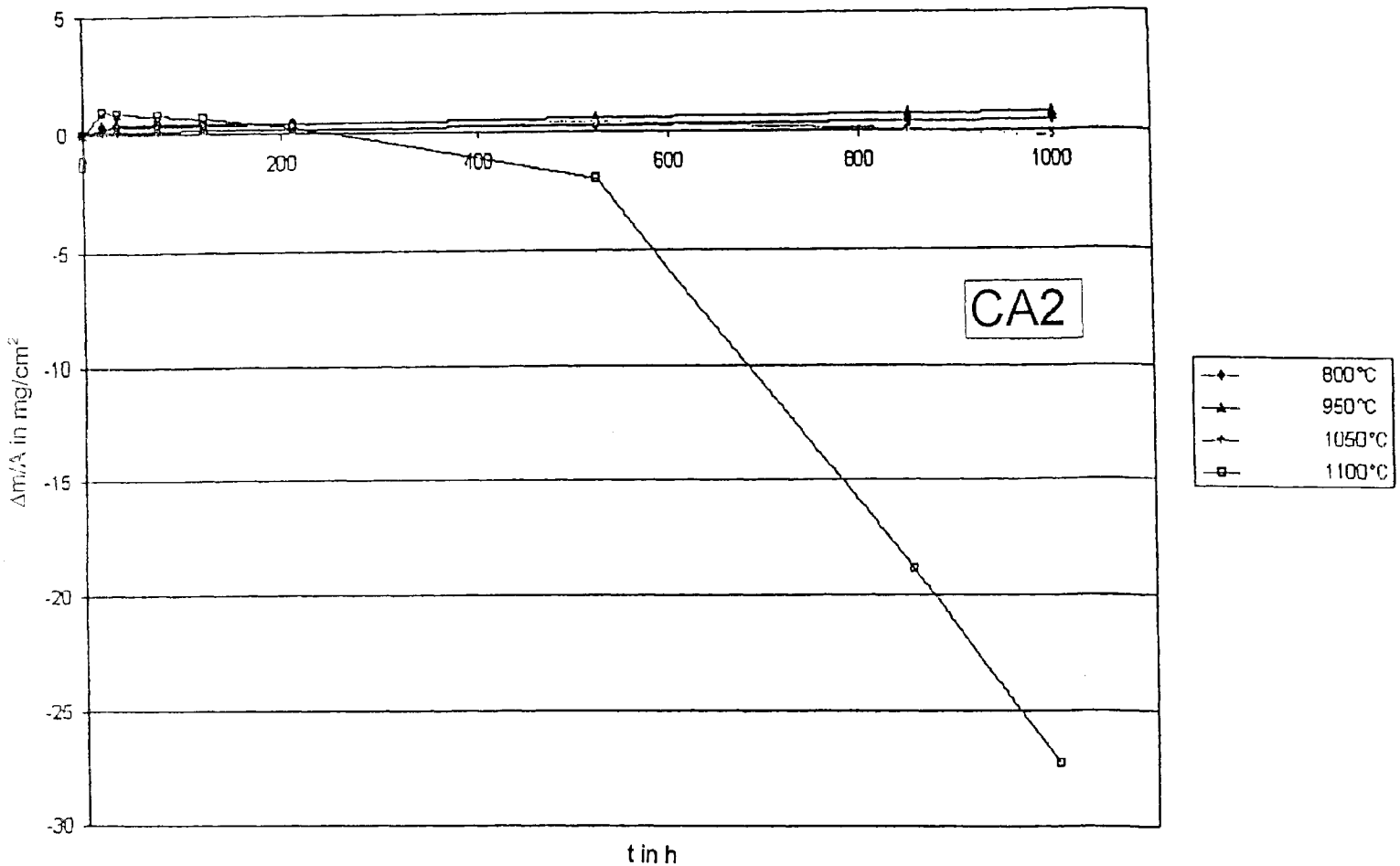
FIG. 2 shows the way in which the specific mass change is dependent on the temperature and time for the comparison alloy CA2.
Figure 3:
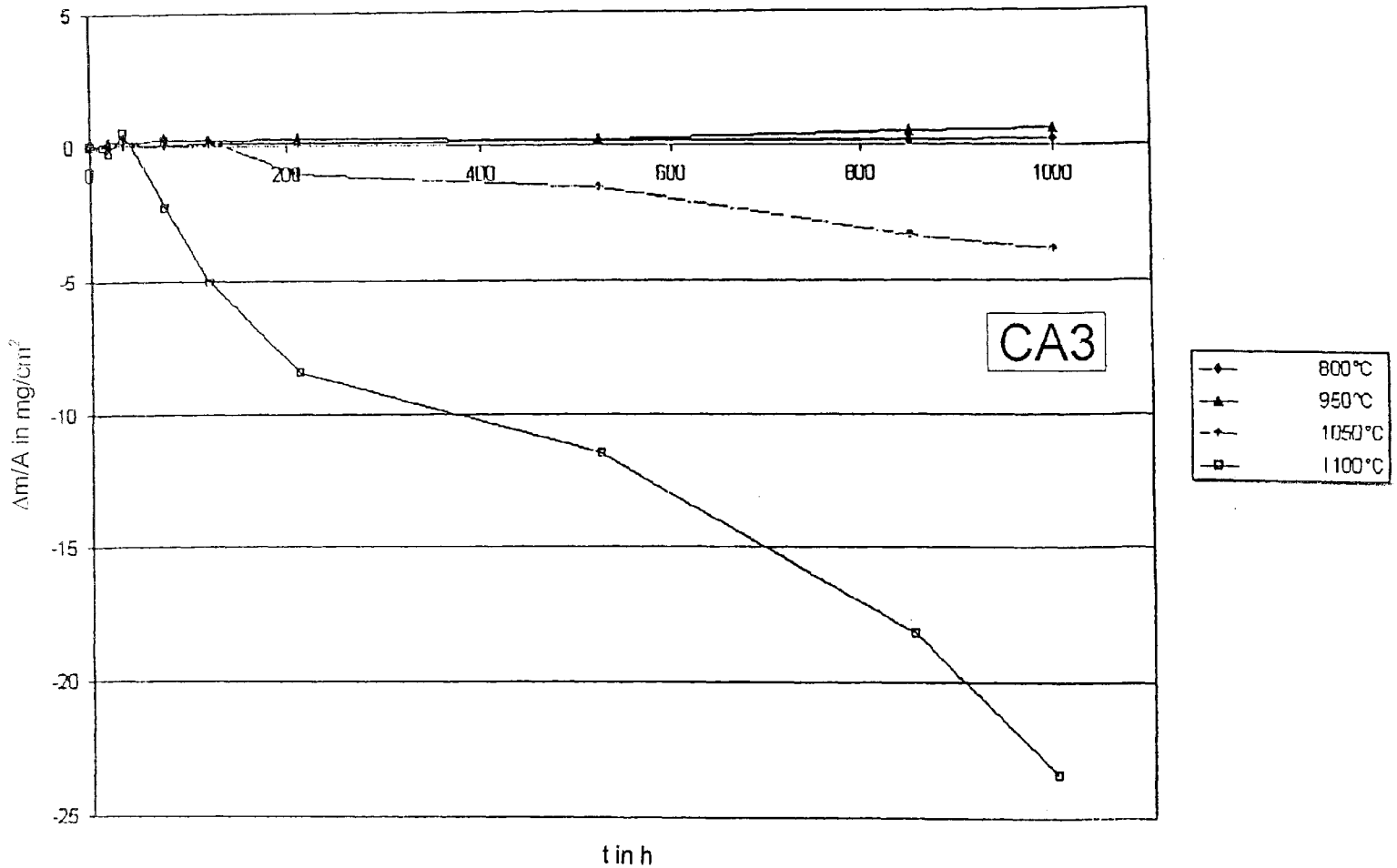
FIG. 3 shows the way in which the specific mass change is dependent on the temperature and time for the comparison alloy CA3.
Figure 4:
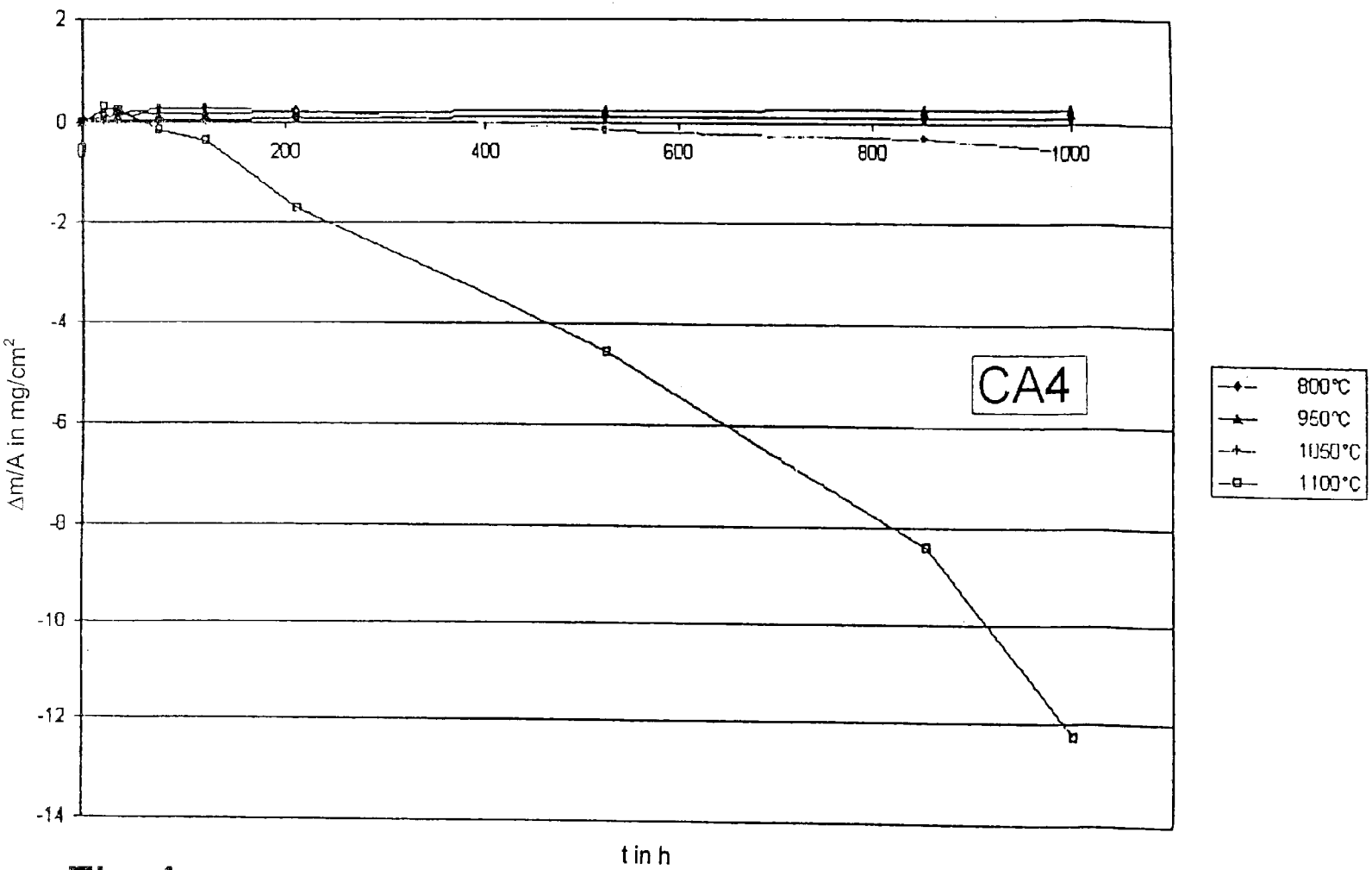
FIG. 4 shows the way in which the specific mass change is dependent on the temperature and time for the comparison alloy CA4.

Referring now to the drawings, the invention will be explained in more detail with reference to an exemplary embodiment and FIGS. 1 to 5.

Nickel-base superalloys having the chemical composition listed in Table 1 were tested (details in % by weight):

TABLE 1

Chemical composition of the alloys tested

| | CA1 (CMSX-11B) | CA2 (CMSX-6) | CA3 (CMSX-2) | CA4 (René N5) | A1 |
|---|---|---|---|---|---|
| Ni | Remainder | Remainder | Remainder | Remainder | Remainder |
| Cr | 12.4 | 9.7 | 7.9 | 7.12 | 7.7 |
| Co | 5.7 | 5.0 | 4.6 | 7.4 | 5.1 |
| Mo | 0.5 | 3.0 | 0.6 | 1.4 | 2.0 |
| W | 5.1 | — | 8.0 | 4.9 | 7.8 |
| Ta | 5.18 | 2.0 | 6.0 | 6.5 | 5.84 |
| Al | 3.59 | 4.81 | 5.58 | 6.07 | 5.0 |
| Ti | 4.18 | 4.71 | 0.99 | 0.03 | 1.4 |
| Hf | 0.04 | 0.05 | — | 0.17 | 0.12 |
| C | — | — | — | — | 0.02 |
| B | — | — | — | — | 0.005 |
| Si | — | — | — | — | 0.12 |
| Nb | 0.1 | — | — | — | — |
| Re | — | — | — | 2.84 | — |

Alloy A1 is a nickel-base superalloy for single-crystal components whose composition is covered by the patent claim of the present invention. By contrast, alloys CA1, CA2, CA3 and CA4 are comparison alloys which are part of the known prior art, available under designations CMSX-11B, CMSX-6, CMSX-2 and René N5. They differ from the alloy according to the invention inter alia above all through the fact that they are not alloyed with C, B and Si.

Carbon and boron strengthen the grain boundaries, in particular including the small-angle grain boundaries which occur in the <001> direction in SX or DS gas turbine blades or vanes made from nickel-base superalloys, since these elements cause the precipitation of carbides and borides at the grain boundaries, which are stable at high temperatures. Moreover, the presence of these elements in and along the grain boundaries reduces the diffusion process, which is a primary cause of the grain boundary weakness. As a result, the castability of long single-crystal components, for example gas turbine blades or vanes with a length of approximately 200 to 230 mm, is considerably improved.

Figure 5:
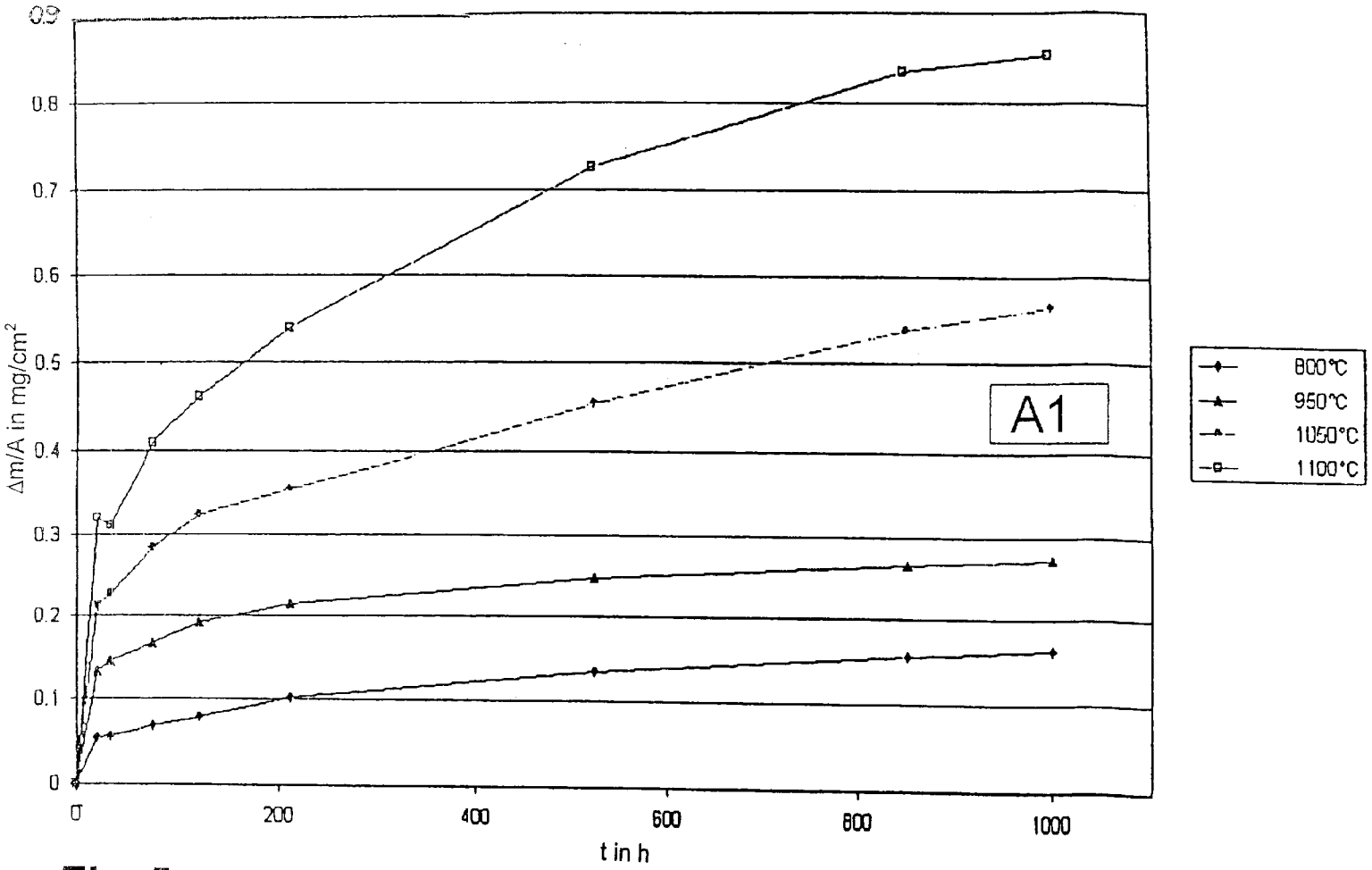
FIG. 5 shows the way in which the specific mass change is dependent on the temperature and time for the alloy according to the invention A1.

The addition of from 0.11 to 0.15% by weight of Si, in particular in combination with approximately the same order of magnitude of Hf, results in a significant improvement in the resistance to oxidation at high temperatures compared to previously known nickel-base superalloys. This becomes clear from FIGS. 1 to 5, which each show a quasi-isothermal oxidation diagram for the comparison alloys CA1 to CA4 (FIGS. 1 to 4) and the alloy according to the invention A1 (FIG. 5). The specific mass change $\Delta m/A$ (details in $mg/cm^2$) at temperatures of 800° C., 950° C., 1050° C. and 1100° C. in the range from 0 to 1000 h is illustrated for each of the abovementioned alloys. If the curves are compared, the superiority of the alloy according to the invention is clear, in particular at the high temperatures (1000° C.) and long aging times.

If nickel-base superalloys with higher C and B contents (max. 750 ppm of C and max. 400 ppm of B) in accordance with claim 1 of the invention are selected, the components produced therefrom can also be cast in the conventional way.

Obviously, numerous modifications and variations of the present invention are possible in light of the above teachings. It is therefore to be understood that within the scope of the appended claims, the invention may be practiced otherwise than as specifically described herein.

What is claimed is:

1. A nickel-base superalloy, characterized by the following chemical composition (details in % by weight):

7.7–8.3 Cr
5.0–5.25 Co
2.0–2.1 Mo
7.8–8.3 W
5.8–6.1 Ta
4.9–5.1 Al
1.3–1.4 Ti
0.11–0.15 Si
0.11–0.15 Hf
200–750 ppm C
50–400 ppm B
remainder nickel and production-related impurities.

2. The nickel-base superalloy as claimed in claim 1, in particular for the production of single-crystal components, characterized by the following chemical composition (details in % by weight):

7.7–8.3 Cr
5.0–5.25 Co
2.0–2.1 Mo
7.8–8.3 W
5.8–6.1 Ta
4.9–5.1 Al
1.3–1.4 Ti
0.11–0.15 Si
0.11–0.15 Hf
200–300 ppm C
50–100 ppm B
remainder nickel and production-related impurities.

3. The nickel-base superalloy as claimed in claim 2, characterized by the following chemical composition (details in % by weight):

7.7 Cr
5.1 Co
2.0 Mo
7.8W
5.8 Ta
5.0 Al
1.4 Ti
0.12 Si
0.12 Hf
200 ppm C
50 ppm B
remainder nickel and production-related impurities.

* * * * *